US005249314A

United States Patent [19]

Sweeny et al.

[11] Patent Number: 5,249,314

[45] Date of Patent: Oct. 5, 1993

[54] WATER CLOSET VOLUME REDUCER

[76] Inventors: H. Dermot Sweeny, 142 Stoneybrook Dr., Kitchener, Ontario, Canada, N2H 4L7; Harry G. Knipe, 32 Gay Crescent, Kitchener, Ontario, Canada, N2A 2C3; John E. Plumridge, 95 Cambridge Street, #1401, Cambridge, Ontario, Canada, N1R 3S2

[21] Appl. No.: 856,694

[22] Filed: Mar. 24, 1992

[51] Int. Cl.[5] ..... E03D 1/00

[52] U.S. Cl. ..... 4/415; 4/227.1

[58] Field of Search ..... 4/415, 227.1–227.7

[56] References Cited

U.S. PATENT DOCUMENTS

| | | | |
|---|---|---|---|
| 3,768,104 | 10/1973 | Sanderson | 4/227.1 |
| 3,811,134 | 5/1974 | Throckmorton et al. | 4/415 |
| 4,225,985 | 10/1980 | Joshi et al. | 4/415 X |
| 4,247,070 | 1/1981 | Dirksing | 4/227.1 X |
| 4,455,692 | 6/1984 | Hegge et al. | 4/227.1 |
| 5,038,416 | 8/1991 | Horne et al. | 4/227.6 |

FOREIGN PATENT DOCUMENTS

| | | | |
|---|---|---|---|
| 2640023 | 6/1990 | France | 4/415 |

*Primary Examiner*—Charles E. Phillips
*Attorney, Agent, or Firm*—Jones, Tullar & Cooper

[57] ABSTRACT

The invention provides a device for reducing the volume of water flushed from a water closet. A rectilinear container has front, rear, side and bottom walls. An elongated suspension member has a hook at an upper end thereof for engaging the rim of the water closet and at its lower end it can engage bearing means on one of the rear or side walls of the container to suspend the container within the water closet. The volume of the container can be adjusted since one of the front or side walls has a lower fixed portion and an upper sliding portion, the sliding portion being vertically slidable relative to the fixed portion. The normal flush volume of the water closet is reduce by the volume of the container, thereby saving water.

7 Claims, 4 Drawing Sheets

WATER CLOSET VOLUME REDUCER

The present invention relates to a device which will reduce the effective volume of a water closet, thereby reducing the volume of water used with each flush.

BACKGROUND ART

The standard water closet or toilet tank normally holds a volume of about 45 litres of water, most of the water being used with each flush of the toilet. With the present need to conserve water, and also to reduce the cost of water used, there is a need to reduce the volume of water used per flush. The need is particularly great in arid areas of the country and also in institutional types of buildings such as hospitals or hotels.

There have been many attempts at reducing the volume of water used per flush. Many people merely insert solid items such as a brick into the water closet so as to displace a portion of the available volume. While this will work there is always the possibility of chemicals leaching from the brick and contaminating the water or staining the interior of the water closet. Other people have placed plastic pails or tubs in the water closet so that they will fill with water but will not permit the contained water to leave, thereby reducing the volume flushed. These will work but they tend to move around within the water closet and they can interfere with the valve mechanism of the water closet. Other people have devised weirs which fit within the water closet and hold back a certain volume of water, preventing it from leaving with the rest of the flush water. The weirs are somewhat expensive to produce and require a degree of manual dexterity to properly position within the water closet. There is thus a need for a simple, inexpensive device that will reduce the flush volume, is easy to install, and will have no deleterious effect on the water or the water closet itself.

SUMMARY OF THE INVENTION

The present invention provides a tub or open-topped container that can be inserted into a water closet and held there by a unique suspension system that can be used with either standard or insulated water closets. The container can be inexpensively moulded from recycled plastics and can be provided in different sizes if desired. Furthermore it can be provided with a sliding wall that can be adjusted to different heights depending on the volume of water to be held back with each flush.

Broadly speaking the present invention provides a device for reducing the volume of water flushed from a water closet comprising: rectilinear container means having surrounding side and bottom walls; at least one elongated suspension member, having a hook section at an upper end thereof and means on the lower end slidably engageable with bearing means on the side wall; and means for adjusting the volume of the container, the adjusting means comprising the side wall being divided into fixed and sliding portions, the sliding portion being vertically slidable relative to the fixed portion.

DESCRIPTION OF THE PREFERRED EMBODIMENT

Figure 1:
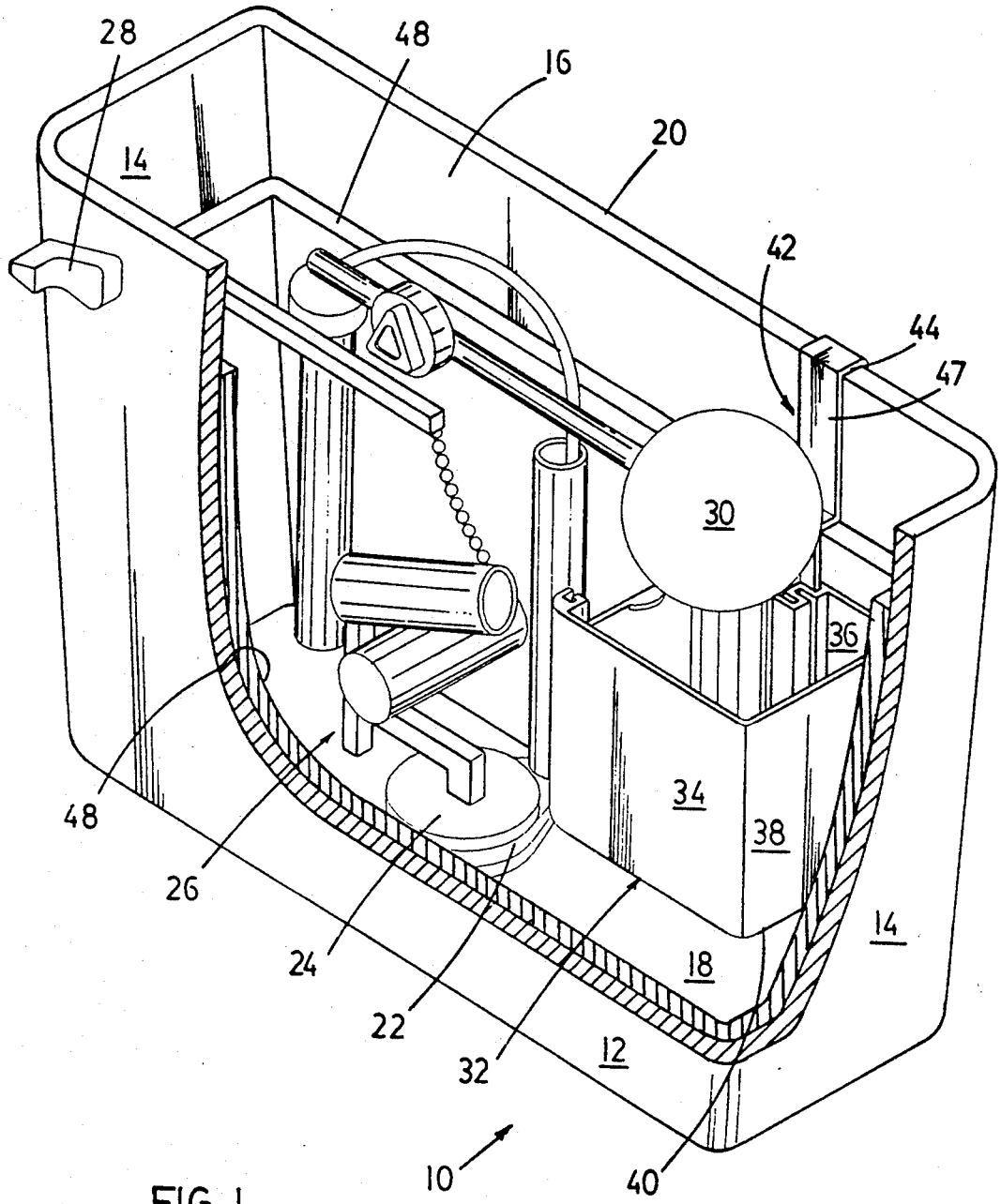
FIG. 1 is a partial section, in perspective of a standard water closet, with a container of the present invention provided therein.

FIG. 1 shows and is representative of a standard water closet found in most residential, hotel and institutional bathrooms. The water closet 10 is in the form of a tank having a front wall 12, side walls 14, a rear wall 16 and a bottom wall 18. The tank has a removable cover 20 and the bottom wall has an opening 22 therethrough which is normally closed by the flapper 24 of a flush valve 26. Details of the flush valve will not be described as they do not form a part of the present invention. It suffices to note that the valve is actuated by a handle 28 found on the front wall 12 of the tank 10. The volume of water which enters the tank is controlled or set by the float 30.

With particular reference to FIG. 1, and the remaining figures, the present invention will now be described. The invention may take the form of a rectilinear container 32 having a surrounding side wall including a front wall 34, a rear wall 36, and side walls 38, and a bottom wall 40. Suspension means in the form of at least one elongated strap 42 are provided to hold the container stationary within the tank 10, the strap 42 having a hook 44 at the upper end thereof for attachment to the rear wall 16 of the tank 10. One of the upright walls of the container has a slidable portion, to be described, with which the volume of the container can be controlled.

Figure 2:
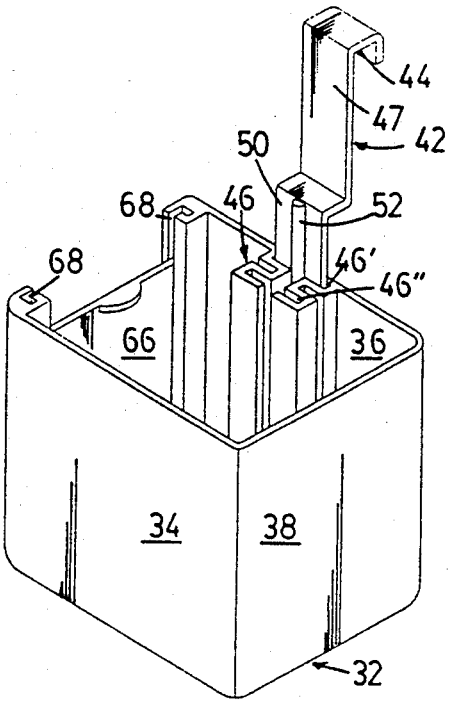
FIG. 2 is a perspective exploded view of a first embodiment of this invention.
Figure 3:
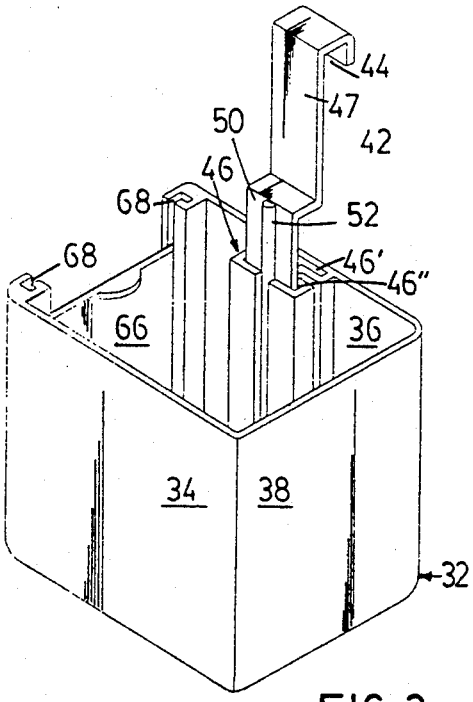
FIG. 3 is a perspective exploded view of the first embodiment in a different configuration.

FIGS. 2 and 3 show a first embodiment of the invention, that embodiment also appearing in FIG. 1. In this embodiment the rear wall 36 of the container has a pair of integrally moulded slots 46 and the strap 42 has an upper offset portion 47 which corresponds in height to the usual distance between the top rim of the tank 10 and the upper edge of foam insulation 48 provided in insulated tanks. The offset is the width of such foam insulation. The slots 46 are spaced in such a manner that with the lower end 50 in the slot 46' adjacent the rear wall 36 the rear wall 36 will rest against the foam insulation 48 if such is within the tank 10. If there is no insulation then the strap lower end 50 is inserted into the other slot 46" so that the rear wall of the container will rest against the rear wall 16 of the tank 10. The hook 44 fits over the rim 20 of the tank to suspend the container within the tank. If it is deemed necessary the strap can have a rib 52 moulded thereon to provide an interference fit with each slot 46.

Figure 4:
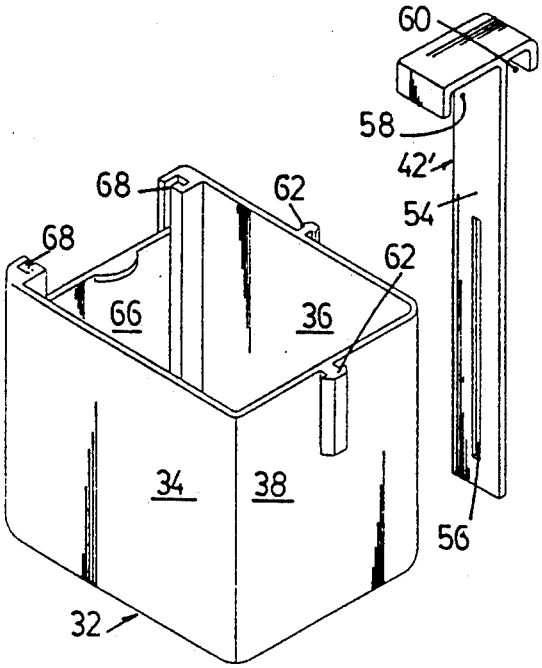
FIG. 4 is a perspective view of a second embodiment of this invention.
Figure 5:
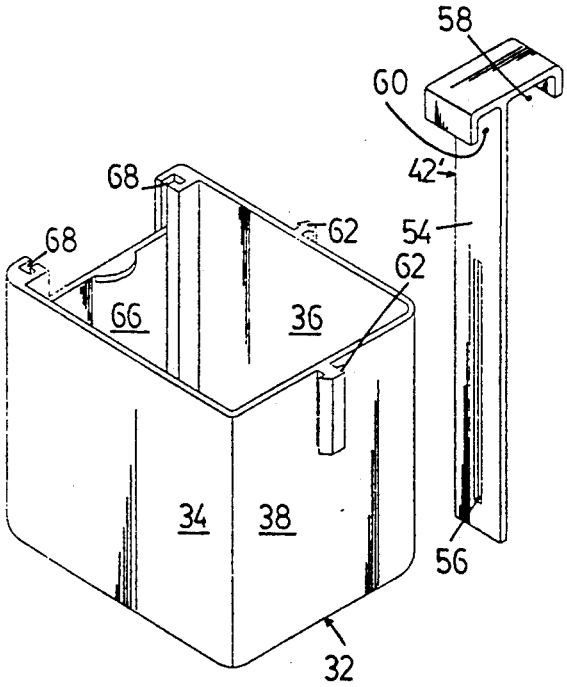
FIG. 5 is a perspective view of the second embodiment in a different configuration.

The embodiment of FIGS. 4 and 5 differs from the first embodiment by having a different strap arrangement. In this case the strap 42' has a lower section 54 with an elongated slot 56 therein. At the upper end the hook portion includes two separate hooks 58 and 60. The hook 58 is similar to the hook of the first embodiment and allows the container to rest against the rear wall of the tank. This is seen in FIG. 4. The hook 60 is longer than the hook 58 and will space the container more inwardly of the tank so that the container can rest against a layer of foam insulation in the tank.

In this embodiment the strap is connected to the container by a flexible T-shaped elongated tab 62 which engages with the slot 56 in the strap. Preferably there will be a tab on the rear wall and another tab on the side wall, thereby increasing the versatility of the invention in that it can be used with almost any style of tank. The fit between the tab and the slot is a friction fit so that the container can be positioned at any desired height within the tank.

Figure 6:
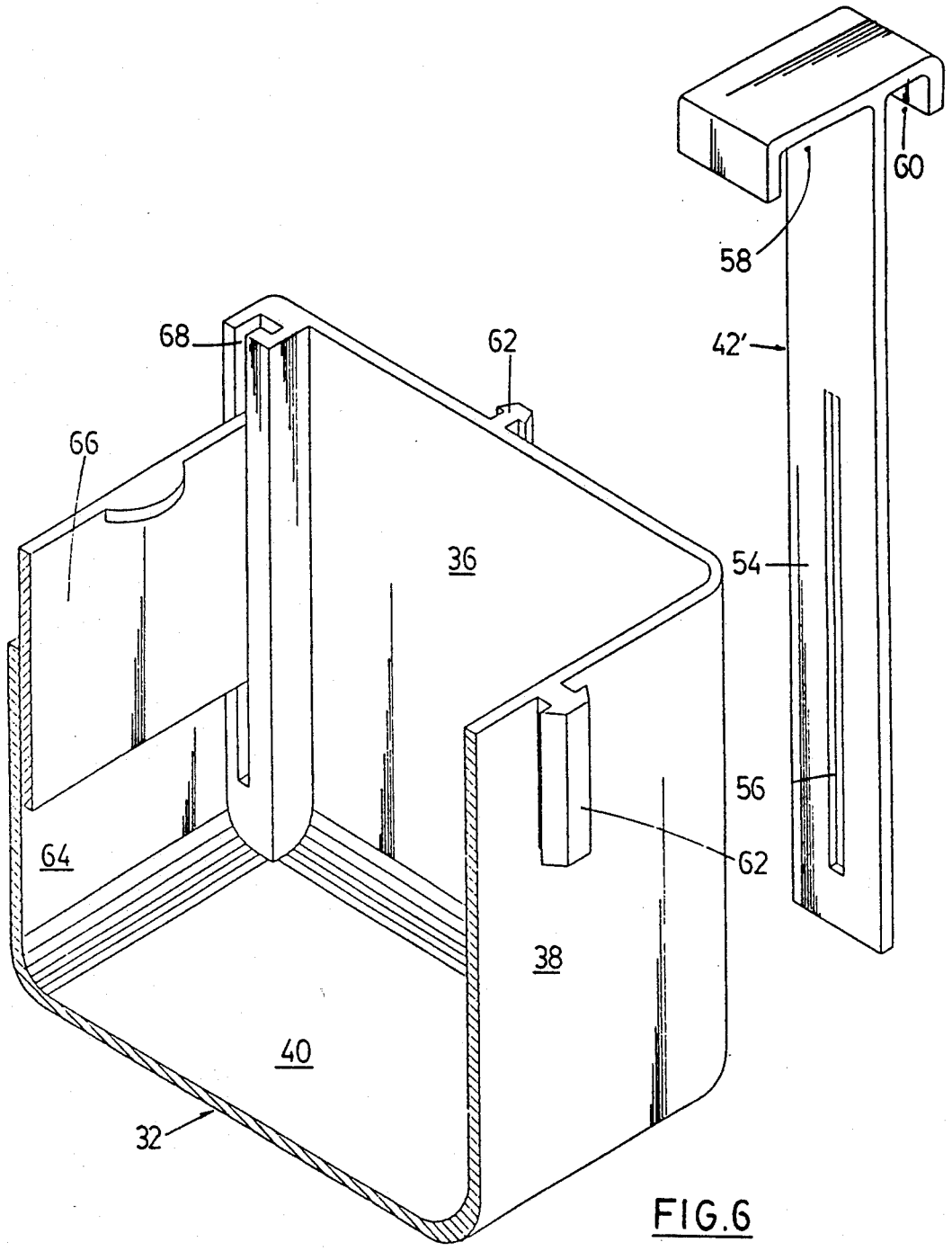
FIG. 6 is a vertical section through the adjustable wall of the container of this invention.

FIG. 6 shows another feature of this invention, namely the adjustability thereof from the standpoint of the volume of water to be held back in each flush. It will be seen that one side wall 38 of the tank includes two portions, a lower fixed section 64 and an upper slidable section 66. The upper section 66 has a sliding, friction fit in a pair of opposed slots 68 provided along the side edge of the front and rear walls of the container. The upper section 66 is in abutting sealing relationship with the lower fixed section 64. By adjusting the sliding section 66 vertically relative to the fixed section 64 one can vary the volume of the container between, say, 2 and 4 liters.

The container of this invention is inexpensive to manufacture, particularly since it can moulded from recycled materials. Preferably the container will be moulded from polyethylene and the strap from polypropylene. These materials are cheap to purchase and they are completely stable, meaning that they will not adversely affect the flush water or the interior of the tank. The container will be so inexpensive to produce that they could be given away by water utilities as a promotion to encourage people to conserve water, particularly in water-starved areas such as the south-western United States. In use, one first of all must determine whether the tank has an insulted rear wall. If it does then one will select the proper slot 46 (first embodiment) or the proper hook 60 (second embodiment) so that the strap will position the container against the insulation. Otherwise one will use the standard slot 46' or hook 58 and will engage the strap with the container. One then positions the container within the tank so that the hook engages the rim 20 of the tank and the container is pushed down into the water in the tank so that it fills with water. When the tank is flushed the water in the container will remain therein and the water flushed into the toilet will be reduced by the volume remaining in the container. Should it appear that there is not enough water leaving the tank one can lower the sliding wall section 66 relative to the fixed section 64 to reduce the volume of the container, thereby increasing the volume leaving the tank.

Figure 7:
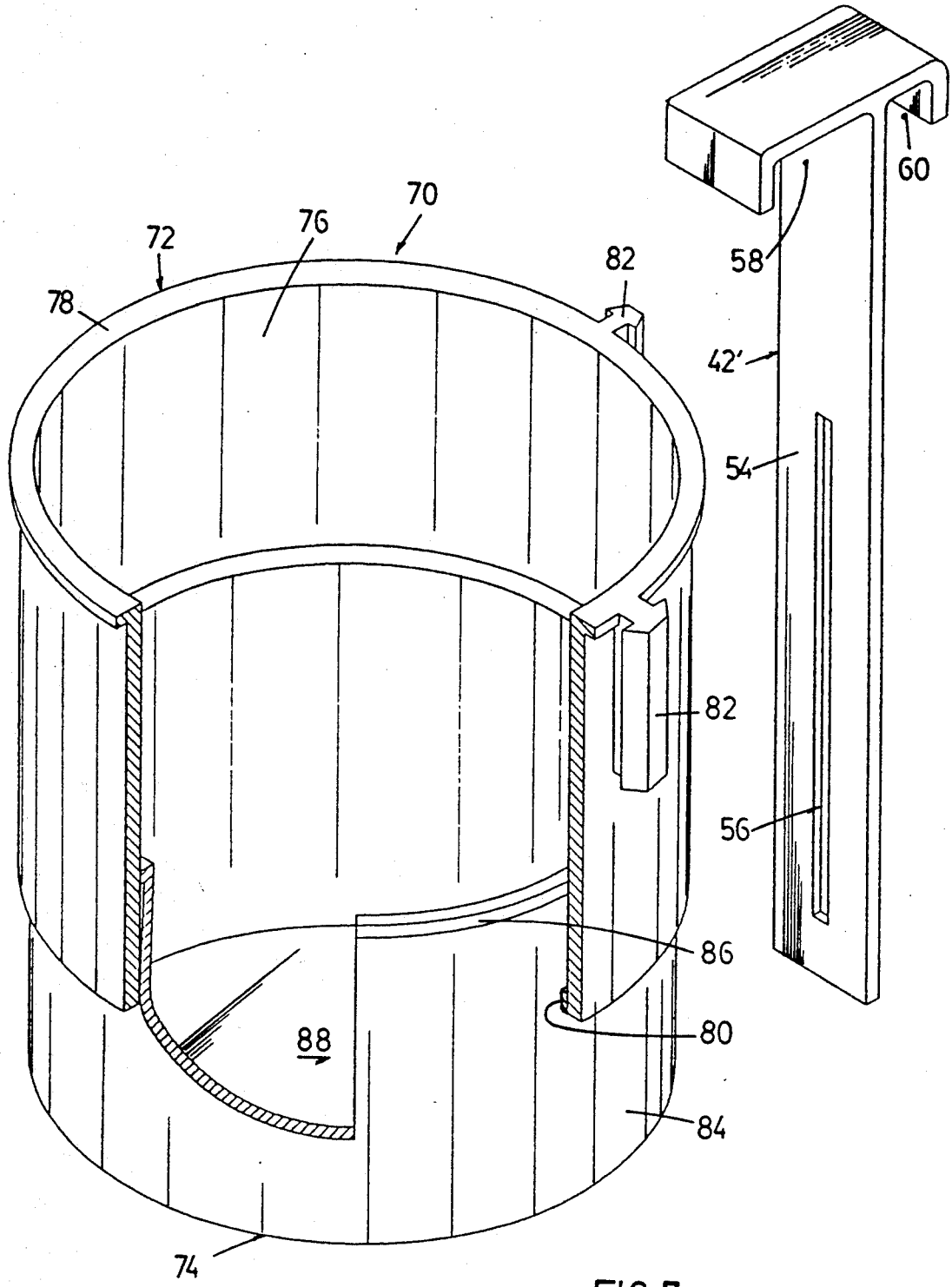
FIG. 7 is a perspective view, partially in section, of a third embodiment of this invention.

FIG. 7 shows another embodiment of the invention which could fit in the tank with less chance of interference with surrounding structure. In this case the container 70 is circular in nature, having an upper fixed cylindrical sleeve-like section 72 and a lower cylindrical cup-like section 74.

The upper section 72 has a surrounding cylindrical side wall 76 with an upper flange or rim 78 and a lower inwardly directed flange lip or flange 80. Integral T-shaped elongated tabs 82, similar to tabs 62, are provided on the side wall 76 for engagement with a support strap 42'. Of course, a support mechanism similar to that of FIGS. 1 to 3 could be utilized.

The lower section 74 has a cylindrical surrounding side wall 84 with an upper outwardly directed rim or flange 86 and a bottom wall 88. The lower section 74 is sealably slidable within the upper sleeve section 72 so as to adjust the volume of the container 70. The lower section 74 is prevented from slipping from the upper section 72 through abutting engagement of the rim 86 with the flange 80, such engagement setting or defining the maximum volume of the container. There should be a tight fit of the rim 86 within the sleeve section 72 to prevent the lower section from inadvertently moving from its desired position within the sleeve section.

Although not shown, the slidable lower section could telescopically mate with the outside of the upper sleeve section rather than with the inside thereof.

The operation of this embodiment and the assembly thereof to a toilet tank is identical as for the previously described embodiments.

It is clear that the present invention meets a long-felt need in that it provides an inexpensive device which effectively and adjustably reduces the volume of water flushed from a water closet or tank and which does not pose an insurmountable installation problem to a home owner. It also will provide considerable benefit to institutions and hotels, greatly reducing the volume of water used daily. A hotel, for example, could purchase a large number of the units, instal one in each tank, and realize savings immediately, without disturbing the clientele or even advising them that the device is in use. It is also apparent that a skilled person could alter the construction of the invention without departing from the spirit thereof, as for example by providing more that one strap to suspend the container within the tank. The protection to be afforded this invention is thus to be determined from the claims appended hereto.

We claim:

1. A device for reducing the volume of water flushed from a water closet comprising: a rectilinear container having surrounding side and bottom walls for holding a volume of water; at least one elongated suspension member for suspending said container within the water closet, said suspension member having a hook section at an upper end thereof and a vertically elongated slot in the lower end; a vertically elongated T-shaped tab on said side wall, said slot being slidably engageable with said tab; and means for adjusting the volume of said container, said adjusting means comprising said side wall being divided into fixed and sliding portions, the sliding portion being vertically slidable relative to the fixed portion.

2. The device of claim 1 wherein said hook section includes a short hook on one side of said suspension member and a longer hook on the other side of said suspension member.

3. The device of claim 2 wherein said container includes a plurality of side wall sections, one of said sections including said fixed and sliding wall portions, and wherein said sliding wall portion is guided in a pair of opposed slots and is located in abutting sealing relationship with said fixed wall portion.

4. The device of claim 1 wherein said container is moulded from recycled plastics material.

5. A device for reducing the volume of water flushed from a water closet comprising: a rectilinear container having surrounding side and bottom walls for holding a volume of water; at least one elongated suspension member for suspending said container within the water closet, said suspension member having a short hook on one side at an upper end thereof, a longer hook on the other side at the upper end thereof, and means on the lower end slidably engageable with guide means on the side wall for securing said elongated suspension member to said container; and means for adjusting the volume of said container, said adjusting means comprising said side wall being divided into fixed and sliding portions, the sliding portion being vertically slidable relative to the fixed portion.

6. The device of claim 5, where said guide means includes a vertically elongated flexible T-shaped tab on a side wall.

7. The device of claim 6, wherein said means engaging said guide means includes an elongated slot in said suspension member and engageable with said T-shaped tab.

* * * * *